US007789325B2

(12) United States Patent
O'Brien

(10) Patent No.: US 7,789,325 B2
(45) Date of Patent: Sep. 7, 2010

(54) AIR ATOMIZING SPRAY NOZZLE WITH MAGNETICALLY ACTUATED SHUTOFF VALVE

(75) Inventor: Michael S. O'Brien, Algonquin, IL (US)

(73) Assignee: Spraying Systems Co., Wheaton, IL (US)

( * ) Notice: Subject to any disclaimer, the term of this patent is extended or adjusted under 35 U.S.C. 154(b) by 190 days.

(21) Appl. No.: 12/009,870

(22) Filed: Jan. 23, 2008

(65) Prior Publication Data

US 2009/0121167 A1 May 14, 2009

Related U.S. Application Data

(60) Provisional application No. 60/897,006, filed on Jan. 23, 2007.

(51) Int. Cl.
*B05B 7/12* (2006.01)

(52) U.S. Cl. ..... 239/417.3; 239/412; 239/417.5; 239/583; 239/DIG. 11

(58) Field of Classification Search ..... 239/407, 239/408, 412, 416.5, 417.3, 417.5, 583, 584, 239/DIG. 11

See application file for complete search history.

(56) References Cited

U.S. PATENT DOCUMENTS 3,224,677 A * 12/1965 Schmidt et al. ..... 239/101
3,625,477 A 12/1971 Vogel
4,637,427 A 1/1987 Nolan et al.
6,182,904 B1 2/2001 Ulczynski et al.

* cited by examiner

*Primary Examiner*—Christopher S Kim
(74) *Attorney, Agent, or Firm*—Leydig, Voit & Mayer, Ltd.

(57) ABSTRACT

A spray device is provided that includes a body portion having a fluid passageway therein. A spray nozzle is affixed to the body portion. The spray nozzle includes a discharge orifice for directing fluid from the fluid passageway in the body portion in a predetermined spray pattern. A valve needle is supported in the body portion and spray nozzle for movement between an open position for permitting fluid discharge through the discharge orifice and a closed position for preventing fluid discharge through the discharge orifice. A control piston assembly is provided for controlling movement of the valve needle. The control piston assembly is movably supported in the body portion and is non-mechanically coupled to the valve needle by magnetic attraction.

18 Claims, 3 Drawing Sheets

AIR ATOMIZING SPRAY NOZZLE WITH MAGNETICALLY ACTUATED SHUTOFF VALVE

CROSS-REFERENCE TO RELATED APPLICATIONS

This patent application claims the benefit of U.S. Provisional Patent Application No. 60/897,006, filed Jan. 23, 2007, which is incorporated by reference.

FIELD OF THE INVENTION

The present invention relates generally to spray nozzle assemblies, and more particularly, to spray nozzle assemblies in which the fluid discharge is controlled by a cyclically operated valve needle.

BACKGROUND OF THE INVENTION

Spray nozzle assemblies having a spray nozzle head which is secured to a nozzle body formed with a flow passageway that communicates with a discharge orifice end in the nozzle are known. For controlling the flow of an application fluid through the nozzle assembly, a selectively movable valve control needle is disposed within the flow passageway. To facilitate pressurized air atomization of the application fluid as it is discharged from the nozzle assembly, an air cap is typically disposed immediately downstream of the spray nozzle head so as to define an air chamber.

It is common to pneumatically operate the valve control needle of these spray nozzle assemblies in such a way to achieve a predetermined relatively high speed cyclic movement between open and closed positions in order to achieve the desired timing and a projected developed spray pattern. Many manufacturing and processing facilities utilize large numbers of these pneumatically operated spray nozzles. In order to operate all of the spray nozzles, such facilities require substantial pressurized control air capacity, which can be very costly.

One problem with such pneumatically controlled spray nozzle assemblies is that the valve needle must be sealed from the pressurized air which controls operation of the valve needle. This typically is done with a packing ring or seal. However, the packing ring or seal creates a significant drag on movement of the valve needle, limiting the rate at which the valve needle can cycle between the open and closed positions. One way in which to compensate for the friction loss caused by the packing rings or seals is to increase the pressure of the control air supply in the facility. Yet, this can be quite expensive. The packing rings or seals are also susceptible to excessive leakage due to poor fit or wear which, in turn, results in inefficient utilization of the pressurized control air supply at the facility. Another problem with the packing rings or seals is that they are difficult to assemble into the spray nozzle assembly.

OBJECTS OF THE INVENTION

It is an object of the present invention to provide a pneumatically controlled spray nozzle assembly that can be operated with substantially improved efficiency.

Another object is to provide a pneumatically controlled spray nozzle assembly that can be more reliably operated at low air pressures.

A related object is to provide a spray nozzle assembly which permits greater numbers of such nozzles to be used in spraying systems for a given pressurized air supply.

A further object is to provide a pneumatically controlled spray nozzle assembly of the above kind which eliminates the need for a packing seal or the like about a valve control needle of the spray nozzle assembly that can create undesirable drag on movement of the valve needle and can experience undesirable wear and leakage which can shorten the effective life of the spray nozzle assembly.

Still another object is to provide a spray nozzle assembly of the foregoing type which is relatively simple in design and construction and which lends itself to economical manufacture and use.

Other objects and advantages of the invention will become apparent upon reading the following detailed description and upon reference to the drawings, in which:

Figures 1, 2, 3:
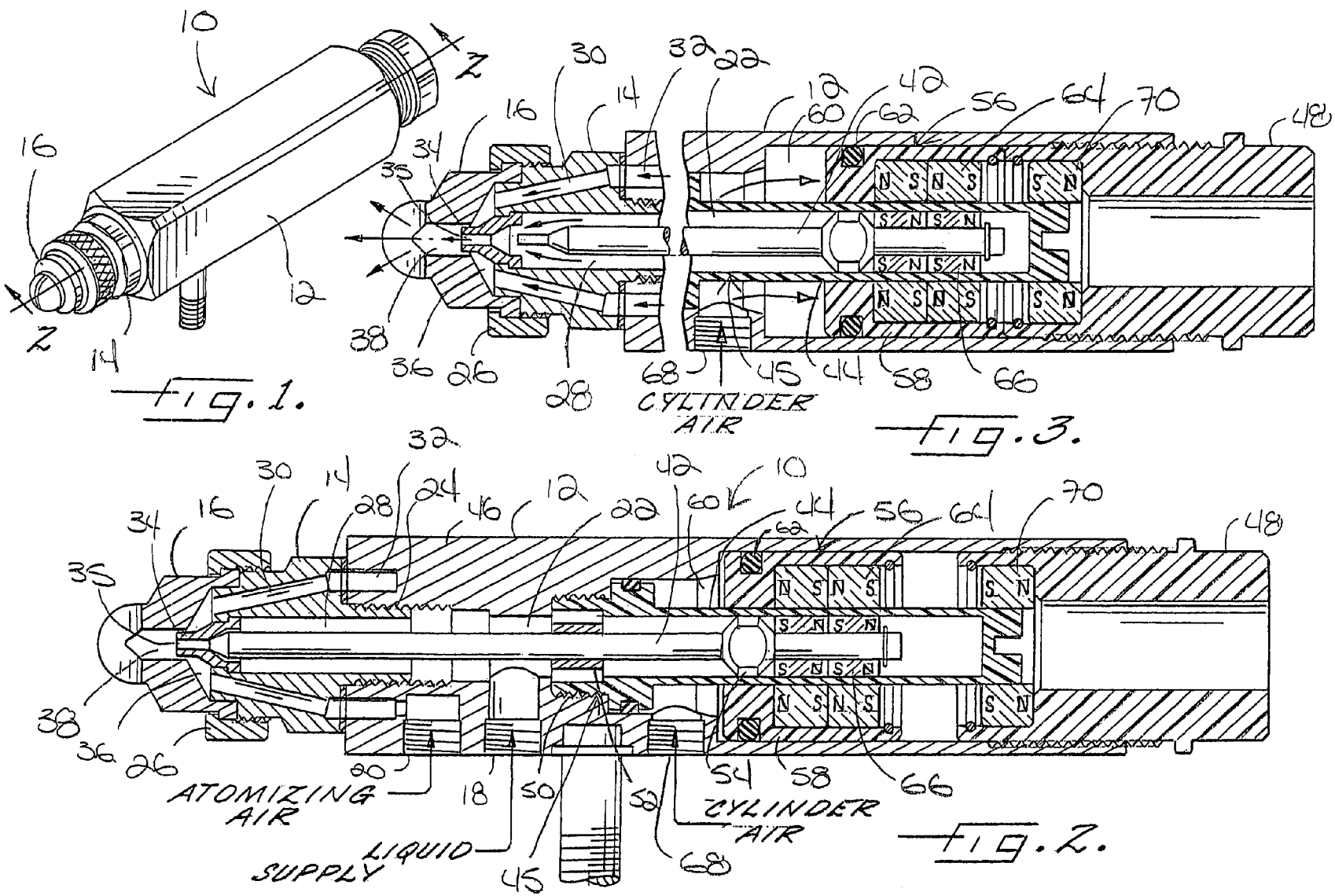
FIG. 1 is a perspective view of an exemplary spray nozzle assembly with a magnetically actuated valve assembly in accordance with the present invention.
FIG. 2 is a cross-sectional view of the spray nozzle assembly of FIG. 1 taken in the plane of line 2-2 of FIG. 1 showing the valve assembly in the closed position.
FIG. 3 is a fragmentary, cross-sectional view of the spray nozzle assembly of FIG. 1 similar to FIG. 2 but showing the valve assembly in the open position.

While the invention is susceptible of various modifications and alternative constructions, certain illustrative embodiments thereof have been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

Referring now more particularly to FIGS. 1-3 of the drawings, there is shown an illustrative spray nozzle assembly 10 in accordance with the invention. In this case, the spray nozzle assembly 10 generally comprises a body portion 12, a spray nozzle 14 mounted on the body portion and an air cap 16 on the spray nozzle 14. The basic structure and operation of the spray nozzle assembly are known in the art, for example, as disclosed in the U.S. Pat. No. 5,707,010. The overall structure and operation of the spray nozzle assembly should be understood to be illustrative of only one example of a spray device with which the present invention can be used.

In this case, the body portion 12 includes the inlets for the various fluid supplies associated with operation of the spray nozzle assembly as shown in FIGS. 2 and 3. In particular, the illustrated body portion 12 includes an application fluid inlet port 18 for connection to a supply of application fluid to be sprayed and an auxiliary fluid port 20 for connection to a pressurized air source (e.g., pressurized air) used to atomize the application fluid being sprayed. The application fluid inlet port 18 communicates with a central fluid passageway 22 in the body portion 12.

The spray nozzle 14 is affixed to the downstream or discharge end of the body portion 12 by a threaded stem 24 engageable in the central fluid passageway 22 in the body portion. The air cap 16, in turn, is mounted on the downstream end of the spray nozzle 14 by a retaining nut 26 that engages a flange on the air cap 16 and threads over the end of spray nozzle 14. For directing the application fluid through the nozzle assembly 10, the spray nozzle 14 includes a central fluid passageway 28 that communicates with the central fluid passageway 22 in the body portion 12. The spray nozzle 14 further includes a plurality of atomizing fluid passageways 30 which communicate with an annular manifold 32 in the body portion 12 that, in turn, is in communication with the atomizing auxiliary fluid inlet port 20.

The spray nozzle 14 includes a forwardly extending nose portion 34 that defines a fluid discharge orifice 35. The nose portion 34 of the spray nozzle 14 extends outwardly from the spray nozzle body into and through an air chamber 36 that is defined about the downstream end of the nozzle body by the air cap 16. The nose portion 34 terminates in a central discharge passage 38 in the air cap 16 that extends downstream from the air chamber 36. The nose portion 34 is slightly smaller in diameter than the central discharge passage 38 in the air cap 16 such that an annular orifice is provided around the nose portion 34 through which the atomizing fluid is discharged parallel to and into the application fluid being discharged through the application fluid discharge orifice 35.

For controlling the flow of application fluid through the discharge orifice 35 in the spray nozzle, the spray nozzle assembly 10 includes a valve assembly 40 including a valve needle 42 that is movable between open (see FIG. 3) and closed (see FIG. 2) positions. In the illustrated embodiment, the valve needle 42 is a long cylindrical element that is supported by the body portion 12 and extends axially through the central fluid passages in the body portion and the spray nozzle 22, 28 to the discharge orifice 35. In the closed position, as shown in FIG. 2, a distal end portion of the valve needle 42 engages and seats against an inside surface of the discharge orifice 35 thereby blocking the application fluid in the central passage 28 of the spray nozzle 14 from exiting through the discharge orifice. In the open position, as shown in FIG. 3, the end portion of the valve needle 42 is retracted away from the discharge orifice 35 so that the application fluid can flow through the discharge orifice and out of the spray nozzle assembly 10.

The valve needle 42 is supported for reciprocating, axial movement in a guide tube 44 which is part of a guide tube assembly 45 included in the body portion. In this case, the body portion 12 comprises a front section 46 which includes the central fluid passageway 22 and the application and atomizing fluid inlets, the guide tube assembly 45 and an end cap 48. The guide tube assembly 45 is arranged in a rearwardly opening recess in the front section 46 of the body and includes a threaded stem 50 that engages complementary threads at the forward end of the recess. The end cap 48, in turn, threads onto the rear end of the front section 46 and also engages the rear end of the guide tube assembly 45. When affixed to the front section 46 of the body portion 12, the guide tube 44 communicates with the central fluid passageway 22 such that application fluid introduced through the inlet 18 circulates around the valve needle 42 in both the central fluid passageways in the front section and the spray nozzle 18, 28 as well as in the guide tube 44.

Figure 4:
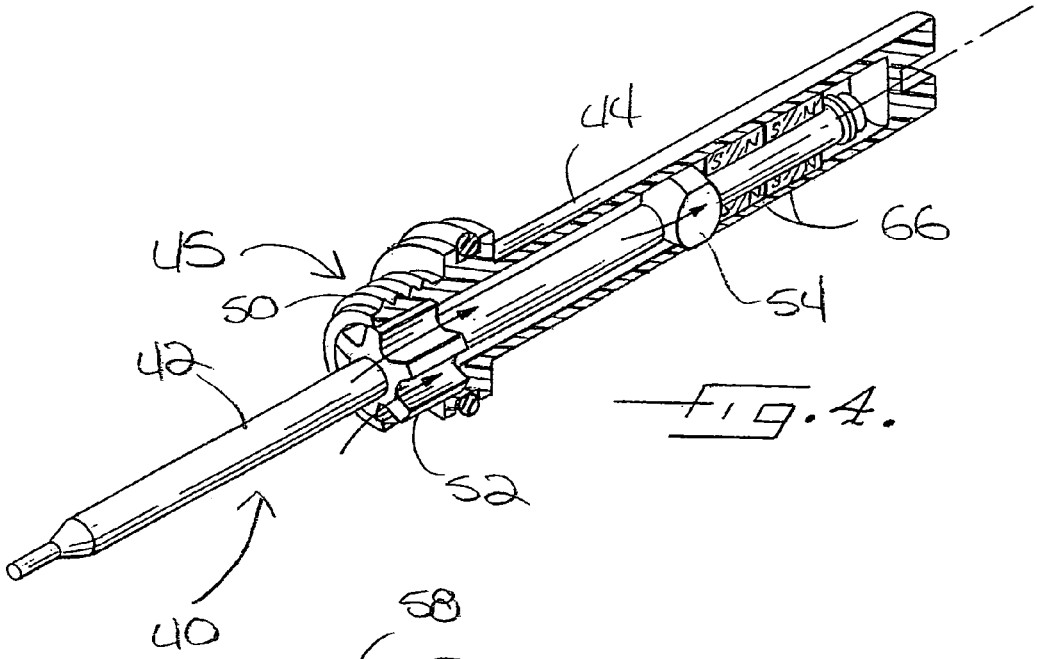
FIG. 4 is a perspective, partial cross-sectional view of the valve assembly of the spray nozzle assembly of FIG. 1.

In the illustrated embodiment, the valve needle 42 slides forward in the guide tube 44 to reach the closed position and rearward to reach the open position. To facilitate this sliding movement, a needle guide 52 is arranged on the valve needle 42 near the forward end thereof. As shown in FIG. 4, the needle guide 52, in this case, has a plurality of radially extending legs that define a series of fluted openings that allow the application fluid to pass the needle guide and thereby circulate through the guide tube 44. The valve needle 42 is further supported for sliding movement in the guide tube 44 by an enlarged section 54 that is arranged closer to the rear end of the valve needle 42. Again, to permit circulation of the application fluid through the guide tube 44, the enlarged section 54 of the valve needle 42 has opposing flat sides that define openings between the enlarged section 54 and the inside wall of the guide tube 44 through which the application fluid can flow (see FIG. 4).

In accordance with an important aspect of the present invention, for effecting movement of the valve needle 42 between the open and closed positions, the valve assembly 40 includes a fluid actuated piston assembly 56 that incorporates a movable carriage 58 that has a non-mechanical coupling with the valve needle 42 that enables the valve needle to move with the carriage (see FIGS. 2 and 3). In carrying out the invention, the valve needle 42 is coupled to the carriage 58 by means of a magnetic field for simultaneous movement with the carriage upon actuation via a pressurized control fluid, e.g. pressurized air. With this arrangement, there is no need to have any leaky packing or seals separate the control fluid from the application fluid as the guide tube defines a solid wall that provides such separation. Thus, the potential for leakage of the control fluid is substantially reduced. Moreover, the elimination of the packing or seals removes a significant source of drag on the movement of the valve needle. As a result, the spray nozzle assembly may be more reliably operated at relatively low control fluid pressures and a greater number of spray nozzle assemblies may be used in a particular application with a given pressurized control fluid supply.

In the illustrated embodiment, the piston assembly 56 is arranged in a control air chamber 60 that is defined in the space between the outer surface of the guide tube 44 and the inside surface of the recess in the front section 46 of the body portion 12. The carriage 58 of the piston assembly is supported on the guide tube 44 for forward and rearward sliding movement in the control air chamber 60. The carriage 58 is preferably made of a low friction material such as Teflon® in order to facilitate the sliding movement on the guide tube 44. A sealing ring 62 is arranged in a groove on the outer surface of the carriage for ensuring a tight seal against the inside surface of the body portion.

Figure 5:
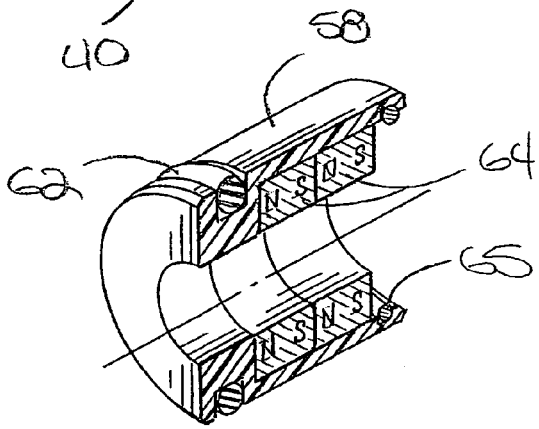
FIG. 5 is a perspective, cross-sectional view of the piston assembly of the spray nozzle assembly of FIG. 1.

For providing the magnetic connection between the piston assembly 56 and the valve needle 42, the carriage 58 includes a cup-shaped recess in which, in this case, two outer annular magnets 64 are arranged. A wire ring 65 is arranged adjacent the open end of the cup-shaped recess to help retain the magnets in the recess as shown in FIG. 5. A pair of inner annular magnets 66 that have a relatively smaller diameter than the outer annular magnets are, in turn, fixed on the valve needle 42 (see FIGS. 2 and 3). Specifically, the inner annular magnets 66 are arranged on the valve needle 42 so that they are radially inward of the outer annular magnets 64 with the outer annular magnets in surrounding relation to the inner annular magnets.

The outer and inner annular magnets 64, 66 are magnetized in the axial direction with the magnetic poles arranged at opposite axial ends of each of the annular magnets. Moreover, the inner annular magnets 66 are arranged such that their poles are arranged in the opposite orientation as the poles of the outer annular magnets 64. In particular, the north poles of the inner annular magnets 66 are aligned with the south poles of the outer annular magnets 64 and the south poles of the inner annular magnets are aligned with the north poles of the outer annular magnets as shown in FIGS. 2 and 3. This alignment ensures that there is a good, strong magnetic connection between the outer and inner annular magnets 64, 66. The outer and inner annular magnets 64, 66 can be constructed of any suitable magnetic material. One suitable type of magnet than may be used is a neodymium rare earth magnet. According to one embodiment, the outer and inner annular magnets can be N42 rated neodymium magnets.

The sliding movement of the carriage 58 is directed by the flow of pressurized control fluid to the control air chamber 60. To this end, the body portion 12 includes a control fluid inlet port 68 in communication with the control air chamber 60 that can be connected to a pressurized control fluid supply. When pressurized control air is directed through the inlet 68 and into the air chamber 60, the pressurized control air forces the carriage 58, and with it the outer annular magnets 64, rearward on the guide tube 44 (see FIG. 3). Because of the magnetic connection between the outer and inner annular magnets 64, 66, this movement of the outer annular magnets 66 pulls the inner annular magnets 64, and with them the valve needle 42, rearward into the open position. Due to the strong magnetic attraction between the outer and inner annular magnets 64, 66, the movement of the valve needle 42 can be controlled without any physical connection between the valve needle and the piston assembly.

Figure 6:
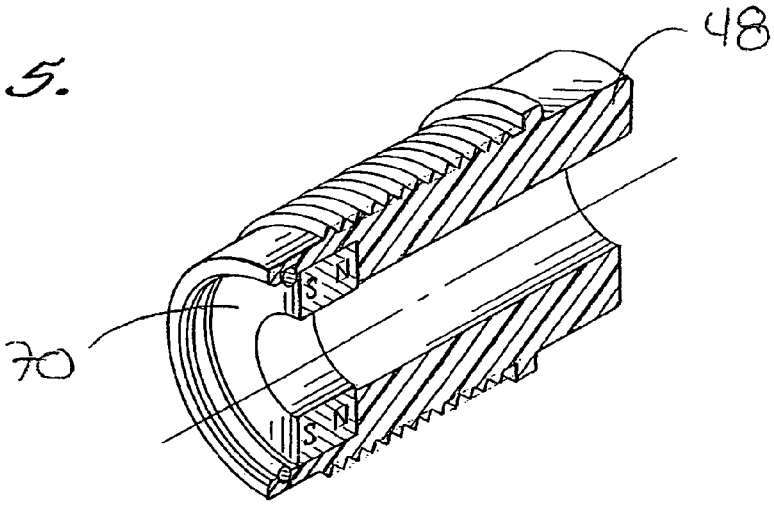
FIG. 6 is a perspective, cross-sectional view of the end cap assembly of the spray nozzle assembly of FIG. 1 showing the magnetic valve return arrangement.

Further in keeping with the invention, the piston assembly 56 can have a non-mechanical valve needle return arrangement for returning the valve needle 42 to its seated, closed position. To this end, a further annular magnet 70 is disposed rearwardly of the valve needle 42 in a recess defined in the end cap 48 of the body portion 12 (see FIGS. 2, 3 and 6). As with the outer and inner annular magnets 64, 66, the rear annular magnet 70 is magnetized in the axial direction such that the opposing poles of the magnet are arranged at opposite axial ends. In this case, the rear annular magnet 70 is of substantially the same diameter as the outer annular magnets 64 supported in the carriage 58. Moreover, the rear annular magnet 70 is arranged with its poles oriented oppositely to those of the outer annular magnets 64. For instance, in the illustrated embodiment, the south pole of the rear annular magnet 70 faces the south pole of the rearmost outer annular magnet 64. In this way, the rear annular magnet 70 pushes or biases the carriage 58 forward in the valve closing direction.

The pressure of the control fluid in the control air chamber 60 must be sufficient to overcome this magnetic biasing force when the carriage 58 is driven rearward to move the valve needle 42 into the open position. When the supply of pressurized control fluid to the control air chamber 60 is shut-off, the magnetic biasing force created by the rear annular magnet 70 and the outer annular magnets 64 returns the carriage 58 and thus the valve needle 42 into the closed position (see FIG. 2). The supply of control fluid to the inlet 68 is controlled externally, such as by solenoid actuated valves. Through such control of the flow of control fluid to the inlet 68, the valve needle 42 may be selectively moved between the open and closed positions, including operation of the valve needle assembly in a high speed cyclic on-off mode.

Figure 7:
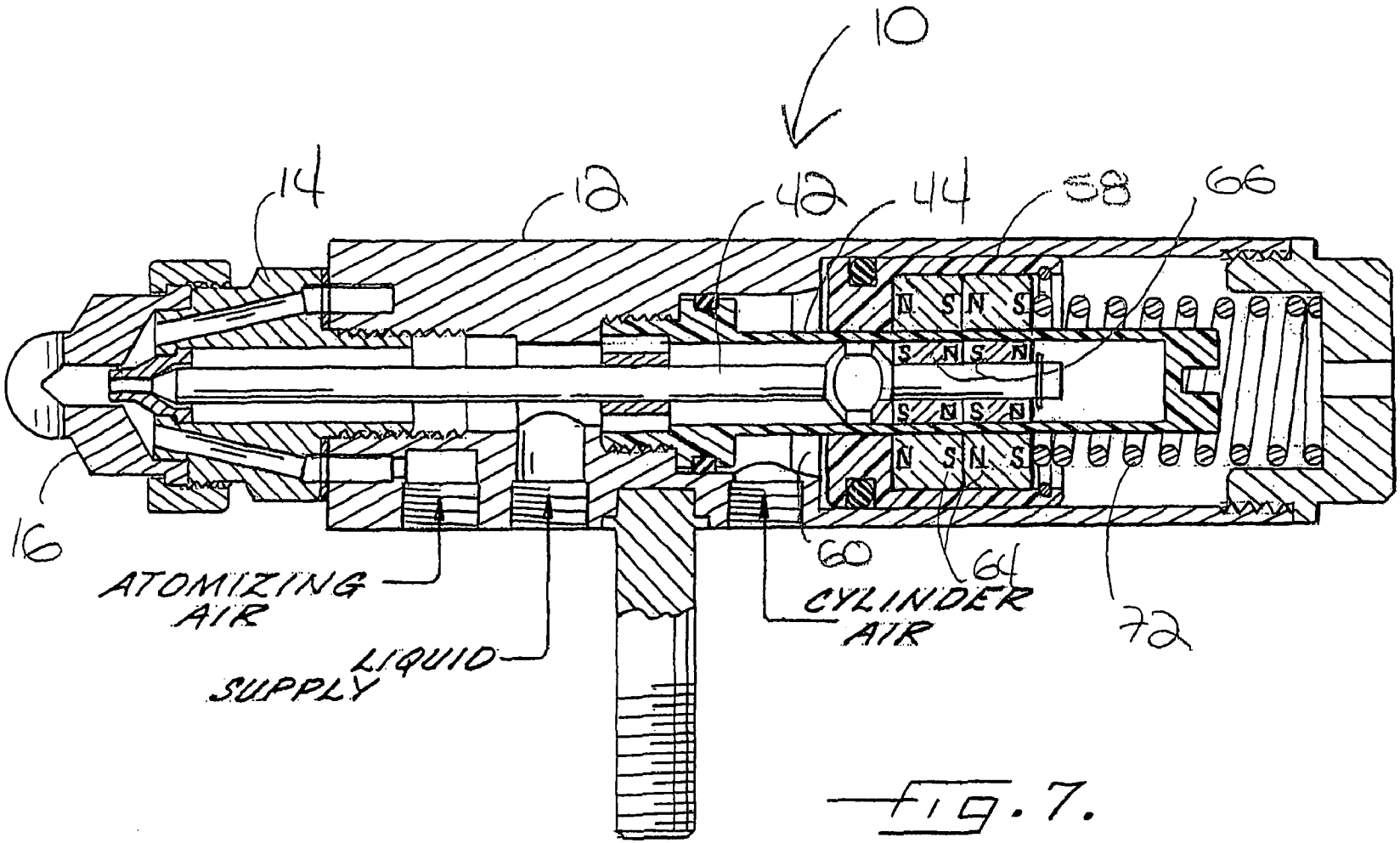
FIG. 7 is a side sectional view of an alternative embodiment of a spray nozzle assembly according to the present invention which includes a spring valve return arrangement.

An alternative valve needle return arrangement is illustrated in FIG. 7. In this arrangement, a spring compression spring 70 is confined between a recess in the end cap 48 of the body portion 12 and the rear end of the carriage 58. Like the rear annular magnet of FIGS. 2 and 3, the compression spring 70 biases the piston assembly 58 and hence the valve needle 42 forward to a fully seated closed position via the magnetic attraction between the outer and inner annular magnets 64, 66.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A spray device comprising:

a body portion having a fluid passageway therein;

a spray nozzle affixed to the body portion, the spray nozzle including a discharge orifice for directing fluid from the fluid passageway in the body portion in a predetermined spray pattern;

a valve needle supported in the body portion and spray nozzle for movement between an open position for permitting fluid discharge through the discharge orifice and a closed position for preventing fluid discharge through the discharge orifice;

a control piston assembly for controlling movement of the valve needle, said control piston assembly being movably supported in the body portion and being non-mechanically coupled to the valve needle by magnetic attraction, said control piston assembly including at least a first magnet, a second magnet affixed to the valve needle, and said first and second magnets being arranged so as to produce the magnetic attraction therebetween.

2. The spray device of claim 1 wherein control piston assembly is arranged in a control air chamber and is actuatable by compressed fluid to move the valve needle in a first direction.

3. The spray device of claim 2 further including a valve return assembly for actuating the control piston assembly to move the valve needle in a second direction opposite the first direction.

4. The spray device of claim 3 wherein the valve return assembly comprises a first magnet that interacts with a second magnet carried by the control piston assembly.

5. The spray device of claim 3 wherein the valve return assembly comprises a spring that biases the control piston assembly so as to move the valve needle in the second direction.

6. The spray device of claim 3 wherein the first direction towards the open position of the valve needle and the second direction is towards the closed position of the valve needle.

7. The spray device of claim 1 wherein the control piston assembly is arranged in surrounding relation to the valve needle.

8. The spray device of claim 7 wherein the first magnet has an annular configuration and is magnetized in an axial direction thereof and the second magnet has an annular configuration and is magnetized in an axial direction thereof with a diameter less than a diameter of the first magnet.

9. The spray device of claim 7 wherein the first magnet has an annular configuration and is magnetized in an axial direction thereof and the second magnet has an annular configuration and is magnetized in an axial direction thereof, the first magnet being arranged in surrounding relation to the second magnet.

10. The spray device of claim 1 wherein the control piston assembly includes a plurality of first magnets and a plurality of second magnets are affixed to the valve needle.

11. The spray device of claim 1 further including an air cap mounted on a downstream end of the spray nozzle for atomizing fluid discharged through the discharge orifice.

12. A spray device comprising:

a body portion having a fluid passageway therein;

a spray nozzle affixed to the body portion, the spray nozzle including a discharge orifice for directing fluid from the fluid passageway in the body portion in a predetermined spray pattern;

a valve needle supported in the body portion and spray nozzle for axial movement between an open position for permitting fluid discharge through the discharge orifice and a closed position for preventing fluid discharge through the discharge orifice;

a control piston assembly for controlling movement of the valve needle between the open and closed positions, the control piston assembly being movably supported in the body portion and being non-mechanically coupled to the valve needle by magnetic attraction, said control piston assembly being arranged in a control fluid chamber and being axially movable in response to pressure fluid introduced into said chamber, said valve needle being axially movable simultaneously with said control piston by reason of magnetic attraction therebetween for moving the valve needle to the open position; and a valve return assembly for actuating the control piston assembly so as to move the valve needle to the closed position, the valve return assembly normally biasing the control piston assembly to move the valve needle towards the closed position.

13. The spray device of claim 12 wherein the valve return assembly actuates the control piston assembly by magnetic repulsion.

14. The spray device of claim 13 wherein the valve return assembly comprises a first magnet that interacts with a second magnet carried by the control piston assembly.

15. The spray device of claim 12 wherein the valve return assembly comprises a spring that biases the control piston assembly so as to move the valve needle in the second direction.

16. The spray device of claim 12 wherein the control piston assembly includes at least a first magnet.

17. The spray device of claim 16 wherein a second magnet is affixed to the valve needle and the first and second magnets are arranged so as to produce the magnetic attraction therebetween.

18. A spray device comprising:

a body portion having a fluid passageway therein;

a spray nozzle affixed to the body portion, the spray nozzle including a discharge orifice for directing fluid from the fluid passageway in the body portion in a predetermined spray pattern;

a valve needle supported in the body portion and spray nozzle for movement between an open position for permitting fluid discharge through the discharge orifice and a closed position for preventing fluid discharge through the discharge orifice;

a control piston assembly for controlling movement of the valve needle in a first direction, the control piston assembly being movably supported in the body portion and being non-mechanically coupled to the valve needle by magnetic attraction, and a valve return assembly that actuates said control piston assembly by magnetic repulsion to move the valve needle in a second direction opposite the first direction.

* * * * *